US007255028B1

(12) United States Patent
Di Bitonto et al.

(10) Patent No.: US 7,255,028 B1
(45) Date of Patent: Aug. 14, 2007

(54) MULTI-BIT PRECISION SCREWDRIVER

(75) Inventors: Anthony Di Bitonto, Brooklyn, NY (US); Anton Ljunggren, New York, NY (US); Paul Katz, New York, NY (US); Michael Circosta, New York, NY (US); Boris Kontorovich, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 11/436,105

(22) Filed: May 17, 2006

(51) Int. Cl.
*B25B 23/00* (2006.01)
*B25G 1/08* (2006.01)
*B25B 23/16* (2006.01)

(52) U.S. Cl. ..... 81/439; 81/492

(58) Field of Classification Search ..... 81/439, 81/492; 7/165
See application file for complete search history.

(56) References Cited

U.S. PATENT DOCUMENTS 686,424 A * 11/1901 Smith ..... 81/438
1,250,328 A * 12/1917 Langford ..... 81/436
2,022,775 A * 12/1935 Holland-Letz ..... 81/439
2,196,849 A * 4/1940 Beeg ..... 81/439
3,114,401 A * 12/1963 Johnson ..... 81/438
3,753,455 A 8/1973 Butler
4,300,607 A * 11/1981 Mellinger ..... 81/490
4,372,362 A 2/1983 Ahn
4,463,788 A 8/1984 Corona et al.
4,572,038 A 2/1986 Graham
4,846,042 A * 7/1989 Wetty ..... 81/490
4,867,326 A * 9/1989 O'Meara ..... 215/250
4,924,733 A * 5/1990 McKenzie ..... 81/438
4,969,231 A * 11/1990 Mader et al. ..... 16/421
5,228,363 A 7/1993 Corona et al.
5,337,637 A 8/1994 Bih-Lien
5,442,982 A 8/1995 Bell
5,526,724 A * 6/1996 Bruggeman ..... 81/492
5,566,596 A 10/1996 Lin
5,613,413 A 3/1997 Huang
5,673,600 A 10/1997 Yanagi et al.
5,823,078 A 10/1998 Liu
5,868,048 A 2/1999 Cassutti et al.
5,904,080 A * 5/1999 Anderson et al. ..... 81/439
5,924,339 A * 7/1999 Huang ..... 81/57.31
6,050,158 A 4/2000 Cassutti et al.

(Continued)

FOREIGN PATENT DOCUMENTS

WO WO89/03282 4/1989

*Primary Examiner*—David B. Thomas
(74) *Attorney, Agent, or Firm*—O'Keefe, Egan, Peterman & Enders, LLP

(57) ABSTRACT

In one embodiment, a screwdriver having interchangeable bit bodies with permanently affixed bit heads is provided. In another embodiment, at least one transparent end cap is provided to display a bit head in an engaged position ready for use. In another alternative embodiment, transparent end caps are provided at two ends of the screwdriver. In still another embodiment, two end caps are provided that may nest with each other. In yet another embodiment a rotatable end cap is provided. The various embodiments of the precision screwdriver may be utilized independently or in combination. One combination provides a screwdriver comprising two transparent, nesting, and rotating caps. A user can apply pressure to an end cap top (whether nested or not) to stabilize the screwdriver for a particular job while rotating the screwdriver independent of the nesting cap top.

26 Claims, 5 Drawing Sheets

U.S. PATENT DOCUMENTS 6,186,036 B1 2/2001 Huang
6,237,451 B1 5/2001 Wei
6,332,384 B1 12/2001 Cluthe
6,354,177 B2 3/2002 Peters
6,374,711 B2 4/2002 Anderson et al.
6,502,484 B2 1/2003 Pao-His
6,508,156 B1 1/2003 Wei
6,601,483 B2 8/2003 Wannop
6,629,478 B2 10/2003 Kozak
6,655,243 B2 * 12/2003 Anderson et al. ..... 81/490
6,923,099 B2 8/2005 Rugg et al.
7,052,128 B1 * 5/2006 Kung-Ping ..... 351/42
2003/0029283 A1 2/2003 Yaar
2003/0084758 A1 5/2003 Chiang
2004/0065178 A1 4/2004 Anderson et al.
2004/0123705 A1 * 7/2004 Howard ..... 81/492
2004/0129119 A1 7/2004 Clarke et al.
2004/0139832 A1 7/2004 Hu
2005/0204878 A1 9/2005 Hu

* cited by examiner

MULTI-BIT PRECISION SCREWDRIVER

TECHNICAL FIELD OF THE INVENTION

This present disclosure relates to precision screwdrivers, and more particularly, to screwdrivers having multiple bits.

BACKGROUND

A variety of types of precision screwdrivers are known in the art. Generally, such screwdrivers provide a small handy screwdriver that may be used for a variety of applications. The portability and functionality of such screwdrivers is often assisted by the provision of multiple screwdriver bits that may be utilized with a single screwdriver. Some of such screwdrivers are formed in a "pen-like" shape having an end cap such that the screwdriver may be easily carried in a shirt pocket or the like. Often, the storage of additional bits, the ease of use of such screwdrivers, the end caps of such screwdrivers have characteristics that result in an inefficient use, a clumsy retention of the various components and a general lack of "user friendliness."

SUMMARY OF THE INVENTION

A precision screwdriver is disclosed having a variety of embodiments for improving efficiency and use. In one embodiment, a screwdriver having interchangeable bit bodies with permanently affixed bit heads is provided. In another embodiment, at least one transparent end cap is provided to display a bit head in an engaged position ready for use. In another alternative, transparent end caps are provided at two ends of the screwdriver. In still another embodiment, two end caps are provided that may nest with each other. In yet another embodiment, a rotatable end cap is provided. The various embodiments of the precision screwdriver may be utilized independently or in combination with one or more of the other embodiments. In one combinational embodiment, a screwdriver comprising two transparent, nesting, and rotating caps is provided. In this embodiment multiple bit heads are displayed in an engaged position ready for use. Nesting end caps at each end of the screwdriver have rotatable tops. Nesting caps can be removed and temporarily affixed to each other, while still allowing for rotation whether stacked or not. A user can apply pressure to an end cap top (whether nested or not) to stabilize the screwdriver as necessary for a particular job while rotating the screwdriver independent of the nesting cap top.

In one embodiment, a screwdriver is provided. The screwdriver may comprise a main body configured to hold a bit body in place. The screwdriver may further include a first end of the screwdriver having a first end cap, the first end cap having a first end cap first portion and a first end cap second portion. The screwdriver may also have a second end of the screwdriver being located at an end opposite of the first end, the second end having a second end cap the second end cap having a second end cap first portion and a second end cap second portion. The screwdriver may be configured such that when each of the end caps is configured to allow rotation between the first portion of the end cap and the second portion of the end cap.

In another embodiment, a screwdriver is provided that comprises a first removable nesting end cap and a second removable nesting end cap, the first and second removable nesting end caps configured to nest with each other. Further, when the first removable nesting end cap and the second removable nesting end cap are nested, a portion of the outer of the two end caps rotates freely with respect to the inner of the two end caps.

In still another embodiment, a screwdriver may comprise a main body configured to hold at least two bit heads, a first bit head at a first end of the screwdriver and second bit head at a second end of the screwdriver. The screwdriver may also include a first end cap covering the first bit head and a second end cap covering the second bit head. Further, the first and second end caps are each configured to allow rotation between first portion of the end cap and a second portion of the end cap In another embodiment, a screwdriver may comprise a main body configured to hold a first bit head and a second bit head, the first and second bit heads being in an engaged position ready for use, the first bit head being at a first end of the screwdriver and the second bit head being at a second end of the screwdriver. The screwdriver may further include a first transparent cap for exposing at least a portion of the first bit head while covering the first bit head while the first bit head is in the engaged position ready for use and a second transparent cap for exposing at least a portion of the second bit head covering the second bit head while the second bit head is in the engaged position ready for use.

DESCRIPTION OF THE DRAWINGS

It is noted that the appended drawings illustrate only exemplary embodiments of the invention and are, therefore, not to be considered limiting of its scope, for the invention may admit to other equally effective embodiments.

DETAILED DESCRIPTION OF THE INVENTION

As described herein, multiple embodiments of a screwdriver are provided. In one embodiment, a screwdriver having interchangeable bit bodies with permanently affixed bit heads is provided. In another embodiment, at least one transparent end cap is provided that displays a bit head in an engaged position ready for use. In another alternative, transparent end caps are provided at two ends of the screwdriver. In still another embodiment, two end caps are provided that may nest with each other. In yet another embodiment, a rotatable end cap is provided. It will be recognized that these various embodiments of a precision screwdriver may be utilized independently or in combination with one or more of the other embodiments. For ease of description, a screwdriver utilizing each of these embodiments in one combination is shown herein with regard to the figures presented. However, this combination is shown for illustrative purposes and a user's preferred embodiment may comprise only one or some subset of a combination of the embodiments and concepts described herein.

Figure 1:
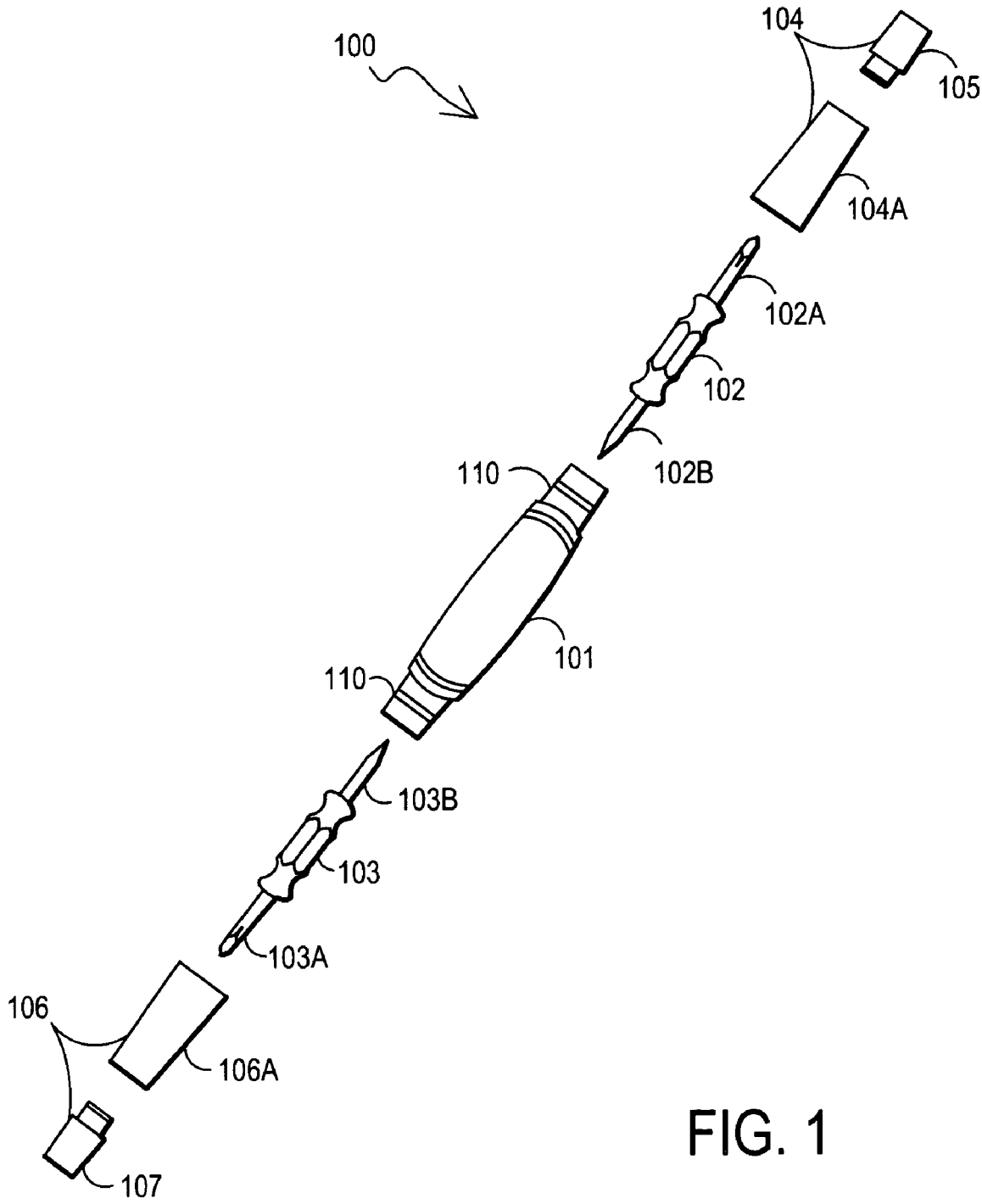
FIG. 1 is an exploded view of a screwdriver.

FIG. 1 shows an exploded side view of one embodiment of a screwdriver 100 having a main body 101 that holds at least two bit bodies 102 and 103, each having at least two bit heads 102A, 102B, 103A and 103B. As shown, the main body 101 may be cylindrically shaped, however, other shapes may be utilized while still advantageously utilizing the various embodiments of the concepts provided herein. It is understood that the main body may hold only one bit body or a main body may hold two or more bit bodies. Bit heads 102A, 102B, 103A and 103B are permanently affixed to the bit bodies 102 and 103 and can be a large Phillips head 103A, a large flat head 103B, a small Phillips head 102A, and a small flat head 102B. Other bits however, may be utilized and alternatively the bits may be detachably affixed to the bit bodies. In FIG. 1, large bit heads 103A and 103B are shown on opposite ends of one bit body 103, while small bit heads 102A and 102B are shown at opposite ends of another bit body 102. It is understood that one bit body could alternatively comprise a small head on one end and a large head at the other end, for example.

The bit bodies 102 and 103 shown in FIG. 1 are configured to be quickly and easily removed and inserted into the main body 101 for exposing a desired bit head size and shape for a particular purpose without having to fumble with removing and inserting individual bit heads into apparatus. Permanently affixed bit heads 102A, 102B, 103A and 103B also alleviate risk of losing individual bit heads 102A, 102B, 103A and 103B. The main body can comprise internal grooves, channels or other similar mechanisms for holding a bit body 102 and 103 into place so that rotation of the main body 101 also results in rotation of the bit body and the exposed bit head.

FIG. 1 shows rotatable nesting end caps 104 and 106 that provide caps to cover the bit heads while also allowing rotation between the main body 101 and at least a portion of the end caps 104 and 106 during use. Each end cap 104 and 106 may nest with the opposing end cap as shown in described in more detail with regard to FIGS. 3–5. Each end cap 104 and 106 has a rotational cap top 105 and 107 and a cap body 104A and 106A. The cap body 104A or 106A rotates about the cap top 105 or 107 during use, which allows a user to apply pressure and stabilize the screwdriver 100 at the cap top 105 or 107 respectively while rotating the main body 101. Further, a first end cap 104 can attach to a second end cap 106 allowing the same rotation of the screwdriver 100 while the cap top 105 remains stationary during use (or vice-versa), as shown in more detail in FIG. 4. While FIG. 1 shows the cap tops 105 and 107 separated from the cap bodies 104A and 106A (respectively) in the exploded view of the screwdriver 100, it is understood that in an exemplary embodiment, the nesting cap top may be permanently rotatably affixed to the cap body. Detents 110 provide a mechanism to allow the end caps 104 and 106 to be snapped in place so that the end caps are prevented from easily falling off the screwdriver. As shown in FIG. 6, each end cap may have a corresponding structure 606 that engages the detent 110 when the cap is placed on the main body of the screwdriver.

Figure 2:
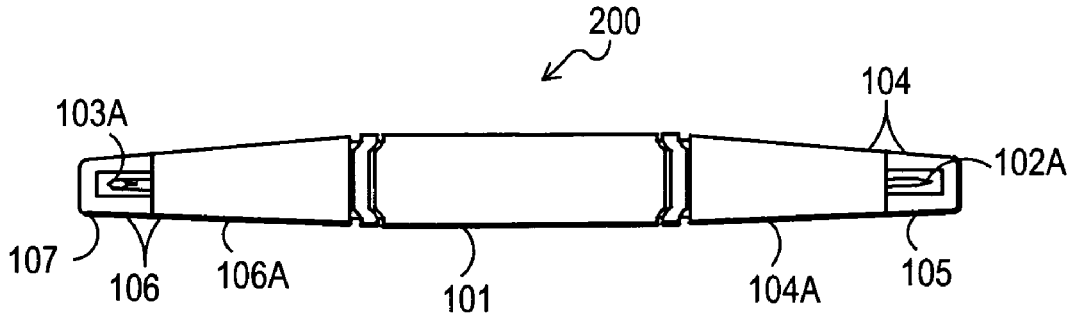
FIG. 2 is a side view of a screwdriver with end caps on both ends.

FIG. 2 shows an exemplary embodiment of a screwdriver 200 with transparent cap tops 105 and 107 displaying bit heads 102A and 103A, thus allowing a user to determine which end of the screwdriver 200 is appropriate for a particular use without having to remove end caps 104 and 106. The bit heads 102A and 103A displayed through the transparent cap tops 105 and 107 are in an engaged position and ready to use. In FIG. 2, exposed bit heads 102A and 103A are a small Phillips head 102A and a large Phillips head 103A. A user familiar with the bit bodies would know from looking through the transparent cap tops 105 and 107 which end of the screwdriver contained large bit heads 103A and 103B and which end housed a bit body having small bit heads 102A and 102B, so that if the user needed a small flat head, for example, the user would remove the end cap 104 covering the small Phillips bit head 102A, remove the bit body from the main body 101, rotate the bit body and insert it into the main body 101 so that the small flat head would be the exposed bit head. In this manner, a user may more directly and easily locate the bit desirable for a particular use.

Figure 3:
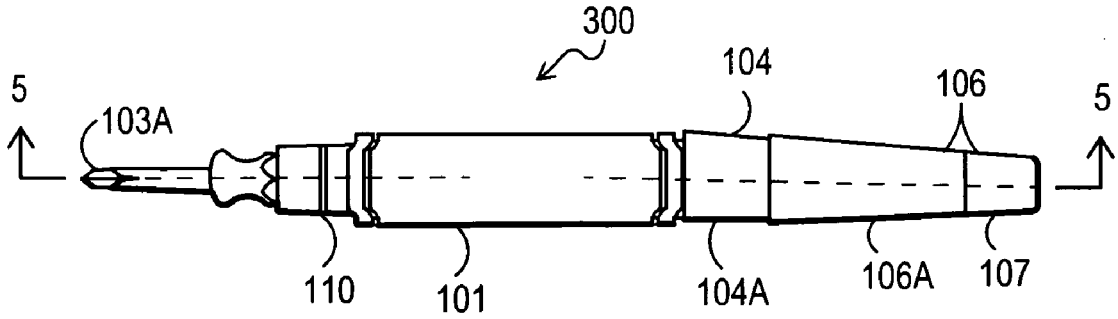
FIG. 3 is a side view of a screwdriver with a first nesting end cap attached to a second nesting end cap.

FIG. 3 shows an embodiment of a screwdriver 300 with a removable nesting end cap 106 temporarily attached to another nesting end cap 104. As shown, the end caps are formed so that one end cap may slide over or nest with the other end cap. In an exemplary embodiment shown, the cap bodies are tapered in a manner that allows nesting. In a nesting use, a first end cap is slide over the second end cap until the cap body of the first end cap firmly engages the cap body of the second end cap. Thus an end cap 104 or 106 can be removed and attached to the other end of the screwdriver 300 in a similar fashion to a ball point pen cap attaching to the end of a ball point pen. Further in the example of FIG. 3, the nesting end caps 104 and 106 are each interchangeable and each may be removed from one end of the screwdriver and attached to an opposite end of the screwdriver. As is described below in more detail, the cap tops of the end caps are rotatable. In the example shown in FIG. 3, the cap bodies of two nested end caps engage each other in a manner that still allows for rotation of the screwdriver with respect to the "top" end cap. Thus, as shown in FIG. 3 the main body 101, cap body 104A and cap body 106A may each be relatively unitarily connected and move together with relation to cap top 107 of end cap 106. In this embodiment, of the nesting caps 104 and 106 engage sufficiently into place when attached to one another so that rotation only occurs at the point between the fully exposed cap top 107 and cap body 106A. As shown in FIG. 3, the main body 101 holds a bit body with permanently affixed bit head 103A now exposed and ready for use while conveniently holding the end cap 106 in a nested arrangement. A large Phillips head is shown in FIG. 3, however the bit body can be removed from the main body 101 and inserted in an opposite direction exposing an alternate bit head, i.e. a large flat bit head, while the end cap 106 remains secured in the nested position.

Figure 4:
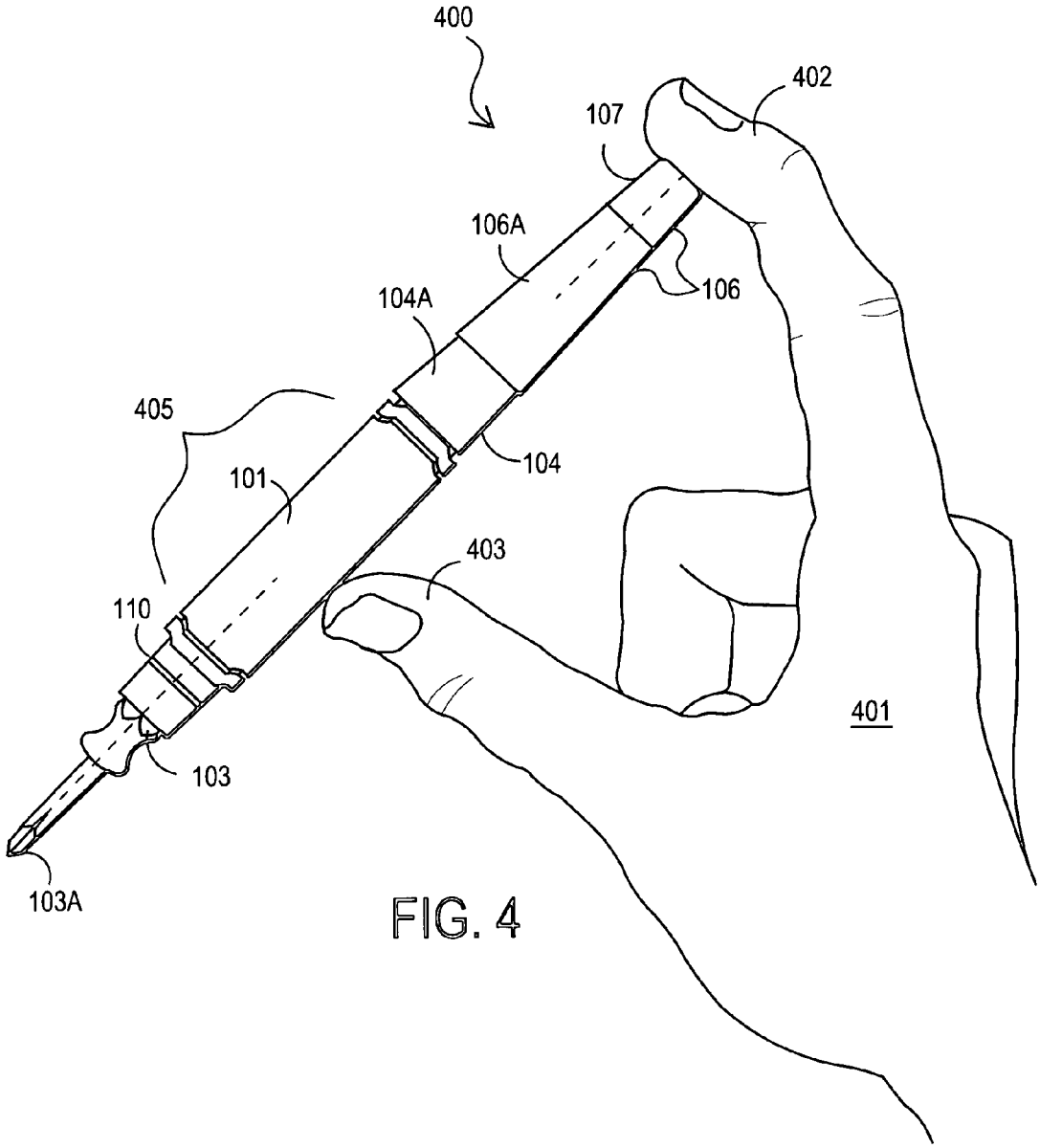
FIG. 4 is a side view of a screwdriver in use.

FIG. 4 shows a screwdriver in use 400, where a hand 401 holds and rotates the screwdriver. For illustrative purposes FIG. 4 shows the rotation of a screwdriver while end caps are nested, however, as will be recognized the rotational movement described below is also provided when end caps are not nested and the rotational concepts described herein may be utilized independently of the nesting of two end caps. As shown, the cap top 107 is configured to allow rotation of the screwdriver 400 while the cap top 107 is stationary. Rotation occurs at a connection of the cap top 107 and cap body 106A (a similar rotation point between cap top 105 and cap body 104A is provided for use when the end caps are nested in an opposite manner or when the caps are not nested).

An index finger 402 applies pressure to a cap top 107 and stabilizes the screwdriver while a thumb 403 or thumb and middle finger (not shown) rotates the screwdriver at the main body 101. It is understood that a user can alternatively apply pressure to the cap top 107 with a palm of a second hand while rotating the main body with the thumb 403 and index finger 402 of the first hand 401, or any other similar technique that is most comfortable and effective for the user. The end cap 106 in FIG. 4 was removed from its previous position over the bit body 103 and bit head 103A and attached to the opposite end of the screwdriver in engagement with the cap body 104A. While attaching the end cap 106 to another end cap 104 is an anticipated technique, it is understood that a removed end cap 106 need not be attached to the screwdriver for it to function as intended while providing rotation. The removed end cap 106 can simply be placed to the side and the rotational aspect of end cap 104 may be utilized while the screwdriver 400 is in use.

Figure 5:
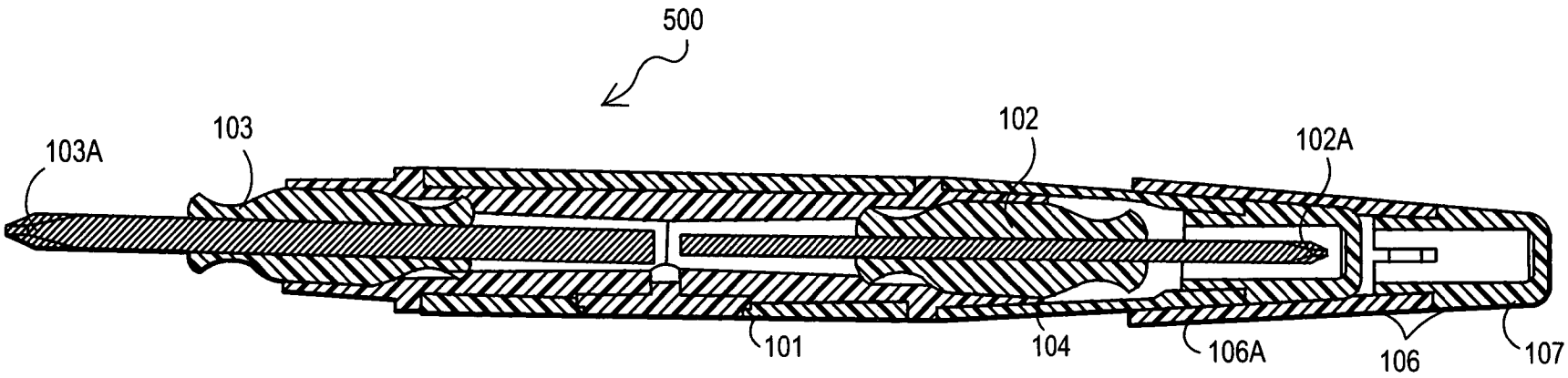
FIG. 5 is a cross section side view of a screwdriver.
Figure 6:
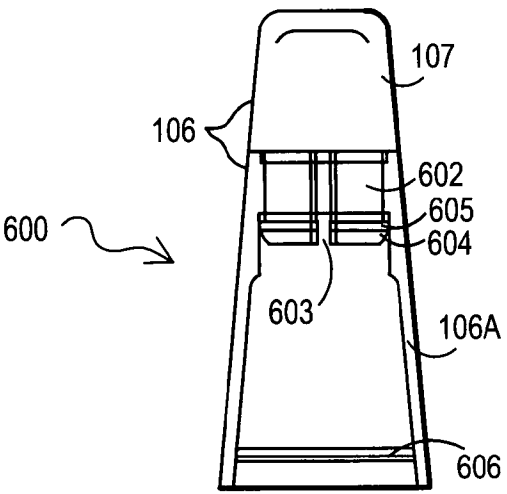
FIG. 6 is a side view of a rotating end cap.

FIG. 5 shows a cross section of a screwdriver 500 as shown in FIG. 3, with a first nesting cap 106 attached to a second nesting cap 104. Bit bodies 102 and 103 are shown housed in a main body 101. The bit bodies 102 and 103 have permanently affixed exposed bit heads 102A and 103A, as well as permanently affixed bit heads on opposite ends of the bit bodies 102 and 103 contained within the main body 101. While only two bit bodies 102 and 103 are shown, it is understood that the main body 101 could be configured to hold more or less than two bit bodies. The ends of the main body 101 are configured to securely engage bit bodies 102 and 103 as shown. It is desirable that the bit bodies be engaged sufficiently tight such that rotation of the main body 101 also rotates the bit bodies 102 and 103 yet still allowing for the bit bodies to be slide out to switch which bit is being utilized. In one embodiment, the bit bodies and the main body may be shaped to securely engage each other, such as for example through the use of hexagon shaped bit bodies and a hexagon shaped cavity within the main body.

FIG. 6 shows a cross section 600 of a screwdriver end cap 106 having a cap top 107 rotatably connected to a cap body 106A. The rotatable connection of cap top 107 may further be understood with regard to FIGS. 7–8 which illustrate a side view of a cap top.

The cap top 107 comprises apertures 603 in a connecting portion 602 that allows for compression such that the cap top may be inserted into the cap body 106A. The cap top 107 further comprises extension members 604 which extend outward from the connecting portion 602. The cap body 106A comprises a top edge 605 configured to engage to the extension members 604 of cap top 107. Thus, the connecting portion 602 may be compressed during insertion into the cap body 106A. Then when the extension members have been slide past the top edge, the connecting portion may then spring or snap back so that the cap top 107 will now be held in a manner such that the cap top will be engaged with the cap body while still allowing rotation between the cap body and cap top. In this manner the cap top is held in place while still being allowed to freely rotate.

Figure 8:
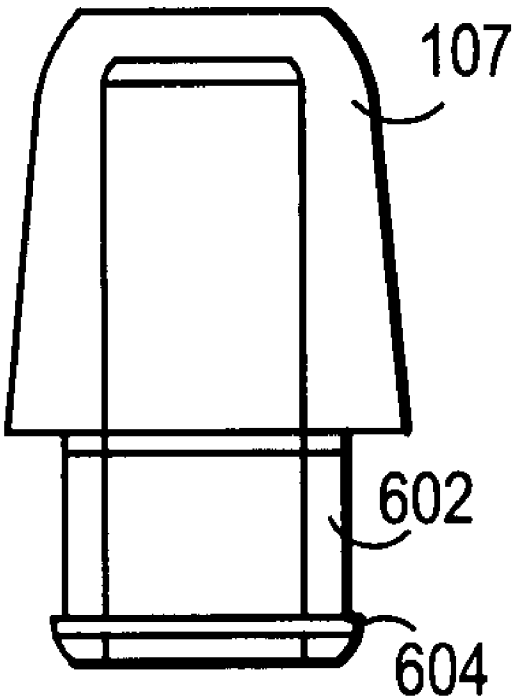
FIG. 8 is another side view of the cap top of FIG. 7.
Figure 7:
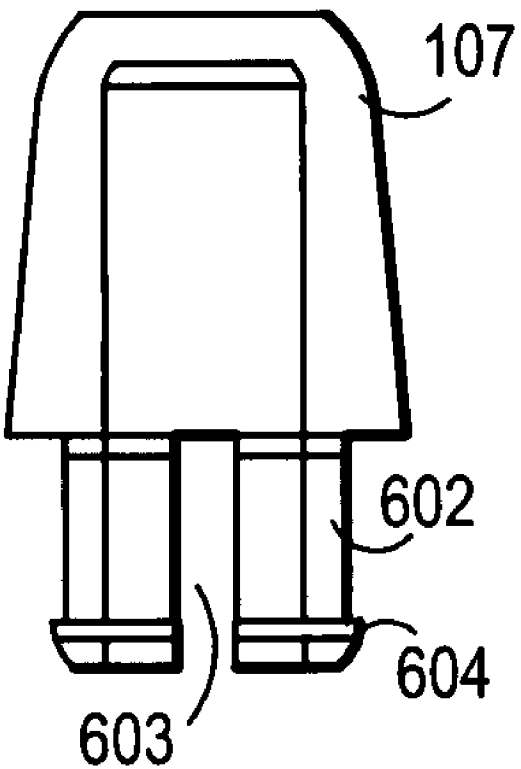
FIG. 7 is a side view of a rotating cap top showing apertures therein.

FIG. 7 shows a side view of a cap top 107 illustrating the apertures 603 (on opposing sides of the cap), the connecting portions 602, and the extension members 604. FIG. 8 is a side view of the cap top 107 rotated ninety degrees with respect to the cross section of FIG. 7 illustrating the connecting portion 602 and the extension members 604. Moreover, it will be recognized that the concepts described herein with regard to a cap top that freely rotates with respect to the cap body may be achieved through any number of structural arrangements and that the structures shown herein are merely exemplary. Thus, with respect to the rotating cap body it is merely desirable that rotation between the cap top and cap body be provided while the particular mechanism utilized to achieve such rotation is merely a design choice. It is noted that in nested arrangements such as shown in FIGS. 3 and 4, the outer cap top (such as cap top 107 of FIGS. 3 and 4) may still freely rotate with respect to its corresponding cap body 106A. Because of the tapered profile of the caps 104 and 106, when in the nested arrangement the outer cap body (cap body 106A in the example shown) securely engages the inner cap body (cap body 104A). Advantageously, when nested the outer cap to 107 is allowed to rotate with respect to the inner cap body 104A. Though achieved through the use of tapered bodies, the concept of utilizing nesting caps with rotation between the outer cap top and the inner cap may be achieved through other structures.

The various screwdriver components described above may be formed of a wide variety of material types, and the concepts described herein may be utilized independent of the materials utilized. In one embodiment, the main body 101 may have an outer exterior of a central region of the main body (such as region 405 shown in FIG. 4) that is utilized as a gripping region made of relatively soft high grip material. For example, the material may be a rubber, elastomeric material, or the like. The bit heads may be formed of a metal and the other components may be injection molded plastic. As mentioned, however, other materials may also be utilized.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed is:

1. A screwdriver, comprising:

a main body configured to hold a bit body in place;

a first end of the screwdriver having a first end cap, the first end cap having a first end cap first portion and a first end cap second portion;

a second end of the screwdriver being located at an end opposite of the first end, the second end having a second end cap, the second end cap having a second end cap first portion and a second end cap second portion; and wherein each of the end caps is configured to allow rotation between the first portion of the end cap and the second portion of the end cap wherein one of the first portion of the first end cap and the first portion of the second end cap extend beyond an end of the bit body when the bit body is held in place by the main body.

2. The screwdriver of claim 1, wherein the bit body is removable from the main body.

3. The screwdriver of claim 2, wherein the bit body has a first bit head and a second bit head.

4. The screwdriver of claim 3, wherein at least one of the first and second end caps comprises:

a cap top that forms the first portion; and a cap body that forms the second portion, wherein rotation between the cap top and cap body is provided.

5. The screwdriver of claim 1, wherein at least some of at least one of the first and second end caps is transparent such that a bit head in an engaged ready to use position is displayed.

6. The screwdriver of claim 1, wherein the first and second end caps may nest.

7. The screwdriver of claim 1, wherein the main body includes at least one region formed of a gripping material.

8. A screwdriver, comprising:

a first removable nesting end cap; and a second removable nesting end cap, the first and second removable nesting end caps configured to nest with each other;

wherein when the first removable nesting end cap and the second removable nesting end cap are nested, a portion of the outer of the two end caps rotates freely with respect to the inner of the two end caps.

9. The screwdriver of claim 8, wherein both of the nesting caps comprises a nesting cap body and a nesting cap top.

10. The screwdriver of claim 9, wherein at least one of the nesting end caps allows rotation with respect to the main body while the one nesting end cap is nested with the other nesting cap.

11. The screwdriver of claim 10, wherein at least some of at least one of the nesting end caps is transparent.

12. The screwdriver of claim 11, wherein the nesting cap top of both the first and second nesting caps is transparent.

13. A screwdriver, comprising:

a main body configured to hold at least two bit heads, a first bit head at a first end of the screwdriver and second bit head at a second end of the screwdriver;

a first end cap covering the first bit head; and a second end cap covering the second bit head, wherein the first and second end caps are each configured to allow rotation between a first portion of the end cap and a second portion of the end cap.

14. The screwdriver of claim 13, wherein first and second end caps are nesting end caps.

15. The screwdriver of claim 14, wherein the first portion of the end caps is a cap body, the cap body of the first end cap and the cap body of the second end cap each being configure to engage each other when in a nested position.

16. The screwdriver of claim 15, wherein at least one of the first and second end caps allows rotation even while attached in a nesting manner to the other end cap.

17. The screwdriver of claim 13, wherein at least a portion of at least one of the first and second end caps has is transparent.

18. The screwdriver of claim 17, wherein the second portion of first end cap is a transparent first cap top and the second portion of the second end cap is a transparent second cap top.

19. The screwdriver of claim 18, wherein the main body includes at least one region formed of a gripping material.

20. A screwdriver, comprising:

a main body configured to hold a first bit head and a second bit head, the first and second bit heads being in an engaged position ready for use, the first bit head being at a first end of the screwdriver and the second bit head being at a second end of the screwdriver;

a first transparent cap for exposing at least a portion of the first bit head while covering the first bit head while the first bit head is in the engaged position ready for use; and a second transparent cap for exposing at least a portion of the second bit head covering the second bit head while the second bit head is in the engaged position ready for use, wherein the first transparent cap has a first transparent cap top and the second transparent cap has a second transparent cap top, and wherein the first transparent cap further comprises a non-transparent first cap body and the second transparent cap further comprises a non-transparent second cap body.

21. A screwdriver, comprising:

a main body configured to hold a first bit head and a second bit head, the first and second bit heads being in an engaged position ready for use, the first bit head being at a first end of the screwdriver and the second bit head being at a second end of the screwdriver;

a first transparent cap for exposing at least a portion of the first bit head while covering the first bit head while the first bit head is in the engaged position ready for use; and a second transparent cap for exposing at least a portion of the second bit head covering the second bit head while the second bit head is in the engaged position ready for use, wherein the first transparent cap has a first transparent cap top and the second transparent cap has a second transparent cap top, and wherein the first transparent cap top is rotatable with respect to another portion of the first transparent cap and the second transparent cap top is rotatable with respect to another portion of the second transparent cap.

22. A screwdriver, comprising:

a main body configured to hold a first bit head and a second bit head, the first and second bit heads being in an engaged position ready for use, the first bit head being at a first end of the screwdriver and the second bit head being at a second end of the screwdriver;

a first transparent cap for exposing at least a portion of the first bit head while covering the first bit head while the first bit head is in the engaged position ready for use; and a second transparent cap for exposing at least a portion of the second bit head covering the second bit head while the second bit head is in the engaged position ready for use, wherein at least a portion of at least one of the first transparent cap and the second transparent cap is non-transparent.

23. A screwdriver, comprising:

a main body configured to hold a first bit head and a second bit head, the first and second bit heads being in an engaged position ready for use, the first bit head being at a first end of the screwdriver and the second bit head being at a second end of the screwdriver;

a first transparent cap for exposing at least a portion of the first bit head while covering the first bit head while the first bit head is in the engaged position ready for use; and a second transparent cap for exposing at least a portion of the second bit head covering the second bit head while the second bit head is in the engaged position ready for use, wherein the first and second transparent caps may nest.

24. A screwdriver, comprising:

a main body configured to hold a first bit head and a second bit head, the first and second bit heads being in an engaged position ready for use, the first bit head being at a first end of the screwdriver and the second bit head being at a second end of the screwdriver;

a first transparent cap for exposing at least a portion of the first bit head while covering the first bit head while the first bit head is in the engaged position ready for use;

a second transparent cap for exposing at least a portion of the second bit head covering the second bit head while the second bit head is in the engaged position ready for use; and a first bit body and a second bit body, the first bit head being attached to the first bit body and the second bit head being attached to the second bit body.

25. The screwdriver of claim 24, further comprising a third bit head attached to the first bit body and a fourth bit head attached to the second bit body.

26. A screwdriver, comprising:

a main body configured to hold a first bit head and a second bit head, the first and second bit heads being in an engaged position ready for use, the first bit head being at a first end of the screwdriver and the second bit head being at a second end of the screwdriver;

a first transparent cap for exposing at least a portion of the first bit head while covering the first bit head while the first bit head is in the engaged position ready for use; and a second transparent cap for exposing at least a portion of the second bit head covering the second bit head while the second bit head is in the engaged position ready for use, wherein the main body includes at least one region formed of a gripping material.

* * * * *